US010401008B2

(12) United States Patent
Jarrard et al.

(10) Patent No.: US 10,401,008 B2
(45) Date of Patent: Sep. 3, 2019

(54) TRACK LIGHTING FIXTURES AND APPLICATION THEREOF

(71) Applicant: Cree, Inc., Durham, NC (US)

(72) Inventors: Andrew J. Jarrard, Raleigh, NC (US); Mai Carr Zakerin, Chapel Hill, NC (US)

(73) Assignee: IDEAL INDUSTRIES LIGHTING LLC, Sycamore, IL (US)

( * ) Notice: Subject to any disclaimer, the term of this patent is extended or adjusted under 35 U.S.C. 154(b) by 15 days.

(21) Appl. No.: 15/422,150

(22) Filed: Feb. 1, 2017

(65) Prior Publication Data

US 2018/0216804 A1 Aug. 2, 2018

(51) Int. Cl.

| | |
|---|---|
| ***F21S 8/06*** | (2006.01) |
| ***F21V 21/14*** | (2006.01) |
| ***F21V 23/00*** | (2015.01) |
| ***F21V 23/02*** | (2006.01) |
| ***F21Y 115/10*** | (2016.01) |

(52) U.S. Cl.

CPC ..... *F21V 23/02* (2013.01); *F21S 8/066* (2013.01); *F21V 21/14* (2013.01); *F21V 23/002* (2013.01); *F21Y 2115/10* (2016.08)

(58) Field of Classification Search

CPC ..... F21V 21/005; F21V 21/14; F21V 23/002; F21V 17/02

USPC ..... 362/648

See application file for complete search history.

(56) References Cited

U.S. PATENT DOCUMENTS

| | | | | |
|---|---|---|---|---|
| 4,907,137 | A * | 3/1990 | Schladitz | F21V 21/32 362/145 |
| 7,275,843 | B2 * | 10/2007 | Mier-Langner | F21V 17/107 362/285 |
| 7,322,735 | B1 * | 1/2008 | Caldani | F21V 21/22 362/285 |
| 7,563,016 | B1 * | 7/2009 | Mier-Langner | F21V 17/107 362/648 |
| 8,662,734 | B2 * | 3/2014 | Covaro | H01R 25/16 362/238 |
| 9,149,350 | B2 * | 10/2015 | Aheam | A61C 19/00 |
| 10,094,543 | B2 * | 10/2018 | Xu | F21V 19/0005 |
| 2004/0005798 | A1 * | 1/2004 | Lin | H01R 25/14 439/110 |
| 2015/0049513 | A1 * | 2/2015 | Haubach | F21V 19/04 362/648 |
| 2017/0130943 | A1 * | 5/2017 | Xu | F21V 19/0005 |
| 2017/0254519 | A1 * | 9/2017 | Tanimura | H01S 5/4012 |

* cited by examiner

*Primary Examiner* — William N Harris

(74) *Attorney, Agent, or Firm* — J. Clinton Wimbish; Nexsen Pruet, PLLC

(57) ABSTRACT

Track heads and associated track lighting systems are provided that obviate a lamp or light bulb holder and associated architecture, such as a gimbal ring. In one aspect, a track head of a track lighting system comprises a track mount and a conduit extending from the track mount and coupling to a baseless light bulb assembly, the conduit comprising electrical leads extending therein and connecting with power circuitry of the baseless light bulb assembly.

25 Claims, 7 Drawing Sheets

TRACK LIGHTING FIXTURES AND APPLICATION THEREOF

FIELD

The present invention relates to track lighting systems and, in particular, to track head fixtures that obviate the holder and/or gimbal ring accessories required for lamp integration into the fixture.

BACKGROUND

Track lighting systems are a popular choice for a variety of lighting applications due to high versatility and multiple design options. Present track lighting systems generally employ track heads requiring a gimbal ring and/or holder for receiving the light source, such as a light bulb or lamp. FIG. 1 illustrates a typical light bulb or lamp for a track light fixture. The light bulb B emits light L from a first end $E_1$. The light bulb B comprises a second end $E_2$ having a base 10 for interfacing with a socket or holder of the fixture. In the embodiment of FIG. 1, the base 10 is an Edison type base for screwing into a socket or holder of the track light fixture. Other lamp or light bulb bases are possible for track light fixtures, including GU 10 and GU 24 bases as well as end plugs. Existence of the lamp base necessarily requires the track light fixture to employ a holder or socket for electrically interfacing with the lamp for operation. FIG. 2 illustrates a prior track light fixture 20 wherein the lamp or light bulb 21 is screwed into or otherwise coupled to a holder or socket 22. FIG. 3 illustrates another embodiment of a prior track light fixture 30 wherein the lamp 31 is coupled to a holder or socket 32. The holder or socket 32 comprises an outer rim 32*a* and side supports 32*b* to provide an integrated appearance for the lamp 31. FIG. 4 illustrates a further embodiment of a prior track light fixture 40 wherein the lamp 41 is coupled to a holder or socket 42. Similar to FIG. 3, the holder or socket 42 comprises an outer rim 42*a* and body 42*b* to provide a monolithic, integrated appearance.

The lamp holder can be integrated into the track head in a number of ways. As provided in FIGS. 2-4, use of a gimbal is a common method of integrating the lamp holder and associated lamp into the track head. However, use of gimbals and other support structures can be cumbersome and aesthetically unpleasing. Gimbals and lamp holders can also increase track head manufacturing time and costs.

In alternative embodiments, track light fixtures have been developed that do not employ lamps or light bulbs. FIG. 5, for example, illustrates a track light fixture 50 wherein light emitting diodes (LEDs) 51 are integrated at the base of a cylindrical housing 52. The interior of the cylindrical housing 52 can comprise reflective surfaces 53. In the embodiment of FIG. 5, the cylindrical housing 52 and associated LEDs 51 are coupled to a driver box 54. FIG. 6 illustrates another embodiment of an integrated LED track light fixture 60. The track light fixture 60 also comprises a cylindrical housing 62 having reflective interior surfaces 63. While being desirable for several applications, integrated LED track light fixtures cannot provide a lamp or light bulb shape/appearance and are often cost intensive to manufacture due to driver and associated LED circuitry requirements.

SUMMARY

In view of these disadvantages, track heads and associated track lighting systems are provided that obviate a lamp or light bulb holder and associated support architecture, such as a gimbal ring, while maintaining lamp or light bulb integration into the head. In one aspect, a track head of a track lighting system comprises a track mount and a conduit extending from the track mount and coupling to a baseless light bulb assembly, the conduit comprising electrical leads extending therein and connecting with power circuitry of the baseless light bulb assembly. By employing a light bulb assembly lacking a base, a track head described herein does not require a holder and/or gimbal assembly for supporting or integrating the light bulb assembly in the track head. For example, the light bulb assembly can comprise a bulb envelope enclosing a light source and the power circuitry of the light bulb, wherein the conduit extending from the track mount couples to the bulb envelope. As described further herein, the conduit can couple to the bulb envelope in any desired manner, including a rotatable joint.

In another aspect, methods of making track heads of a track lighting system are described. A method comprises providing a track mount and extending a conduit from the track mount to couple with a baseless light bulb assembly, the conduit comprising electrical leads extending therein. The electrical leads are connected with power circuitry of the baseless light bulb assembly. In some embodiments, the conduit is coupled to the bulb envelope of the baseless light bulb assembly, wherein the electrical leads pass through the bulb envelope for connection with the bulb power circuitry.

In a further aspect, track lighting systems are described herein. A track lighting system comprises one or more powered rails or powered monopoints. The track lighting system also comprises one or more track heads, a track head comprising a track mount and a conduit extending from the track mount and coupling to a baseless light bulb assembly, the conduit comprising electrical leads extending therein and connecting with power circuitry of the baseless light bulb assembly.

These and other embodiments are described in more detail in the detailed description which follows.

DETAILED DESCRIPTION

Figure 1:
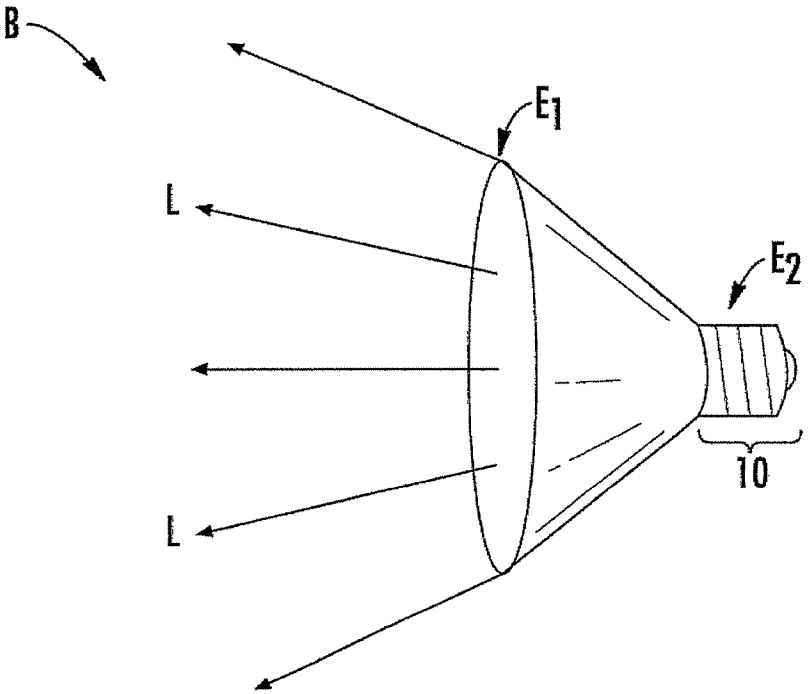
FIG. 1 PRIOR ART
FIG. 1 illustrates a prior light bulb or lamp of a track light fixture.
Figure 4:
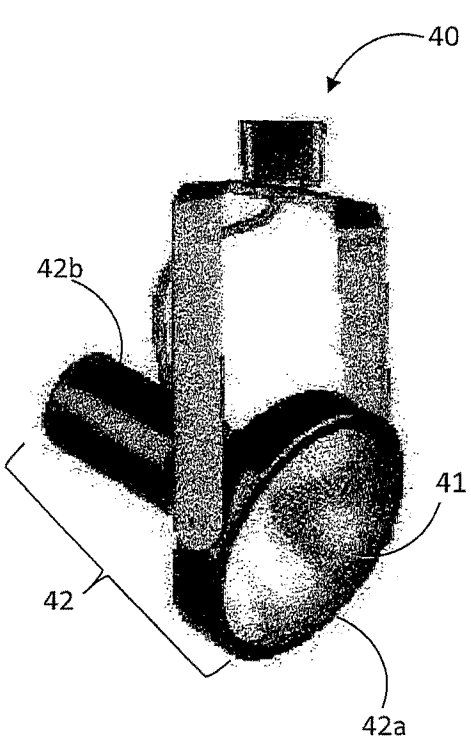
FIG. 4 PRIOR ART
FIG. 4 illustrates a prior track light fixture employing a lamp holder and gimbal architecture.

Embodiments described herein can be understood more readily by reference to the following detailed description and examples and their previous and following descriptions. Elements, apparatus and methods described herein, however, are not limited to the specific embodiments presented in the detailed description and examples. It should be recognized that these embodiments are merely illustrative of the principles of the present invention. Numerous modifications and adaptations will be readily apparent to those of skill in the art without departing from the spirit and scope of the invention.

It will be understood that, although the terms first, second, etc. may be used herein to describe various elements, these elements should not be limited by these teens. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

In one aspect, track heads for track lighting systems are provided. A track head comprises a track mount and a conduit extending from the track mount and coupling to a baseless light bulb assembly, the conduit comprising electrical leads extending therein and connecting with power circuitry of the baseless light bulb assembly. The baseless light bulb assembly can comprise a bulb envelope enclosing a light source and the power circuitry. The conduit can couple to the bulb envelope with the electrical leads therein passing through the bulb envelope to connect with the power circuitry of the light bulb assembly. Electrical leads traveling along the conduit and passing into the bulb envelope for connecting with power circuitry can obviate a light bulb base, such as an Edison base or other base design. Concomitantly, a light bulb holder or socket is not required for integrating the light bulb assembly into the track head. The conduit coupled to the bulb envelope can provide sufficient mechanical support in addition to the electrical connections for bulb operation. The absence of a light bulb socket or holder can also obviate the need for associated support apparatus such as a gimbal.

Figure 7:
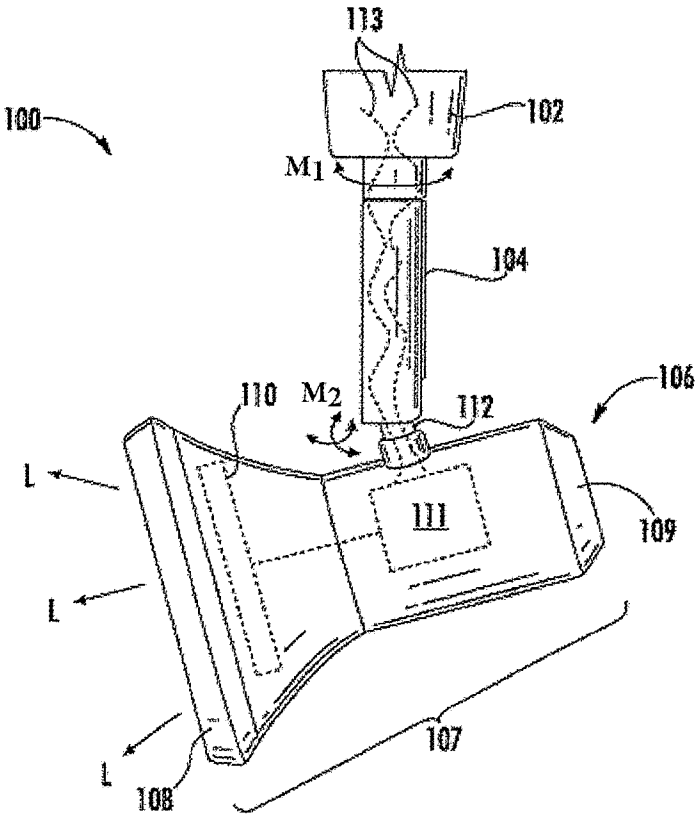
FIG. 7 illustrates a perspective view of a track head according to some embodiments described herein.

FIG. 7 illustrates the foregoing principles according to one non-limiting embodiment. The track head 100 illustrated in FIG. 7 comprises a track mount 102 and a conduit 104 extending from the track mount 104 to couple to a baseless light bulb assembly 106. As the light bulb assembly 106 lacks a base, the exterior of the bulb assembly 106 can form the bulb envelope 107. Accordingly, the bulb envelope 107 extends from the light emitting face 108 of the light bulb assembly 106 to the opposing end 109 where a base would normally reside if present. The bulb envelope 107 encloses the light source 110 and associated power circuitry 111. In the embodiment of FIG. 7, the conduit 104 couples directly to a side of the bulb envelope 107 via joint 112. A joint 112 coupling the conduit 104 to the bulb envelope 107 can provide one or more degrees of directional movement or adjustment of the light bulb assembly 106. It is contemplated that the conduit 104 can couple to any suitable surface of the bulb envelope 107. The conduit, for example, can couple to any side surface of the bulb envelope 106 as illustrated in FIG. 7. Alternatively, the conduit 104 can couple to an end surface 109 of the bulb envelope 107 as provided in FIG. 8 discussed below. Coupling location of the conduit 104 with the bulb envelope 107 can be selected according to several considerations including, but not limited to, desired aesthetic features of the track head 100 and desired range of directional motion of the baseless light bulb assembly 106. In some embodiments, the joint 112 can permit any desired rotational and/or elevational movement of the light bulb assembly 106. The joint 112, for example, can be a ball joint. M2 depicts various directional movements of the light bulb assembly 106 enabled by the joint 112. In some embodiments, the light bulb assembly 106 can rotate a full 360 degrees. In other embodiments, the light bulb assembly can rotate less than 360 degrees, such as 270 degrees or 180 degrees. In addition, the light bulb assembly 106 can exhibit elevational movement of 10 degrees to 170 degrees or any subset thereof.

Electrical leads 113 extend in the conduit 104 and pass into the bulb envelope 107 for connection with the power circuitry 111. In this way, the light bulb base and associated holder or socket are not required for bulb operation and can be eliminated from the track head design. The conduit 104 coupled to the bulb envelope 107 provides sufficient mechanical support and freedom of directional movement via joint 112. Therefore, support architectures, such as a gimbal, are also eliminated from the track head. In some embodiments, the conduit 104 has rotatable engagement $M_2$ with the track mount 102 offering additional directional movements.

Figure 8:
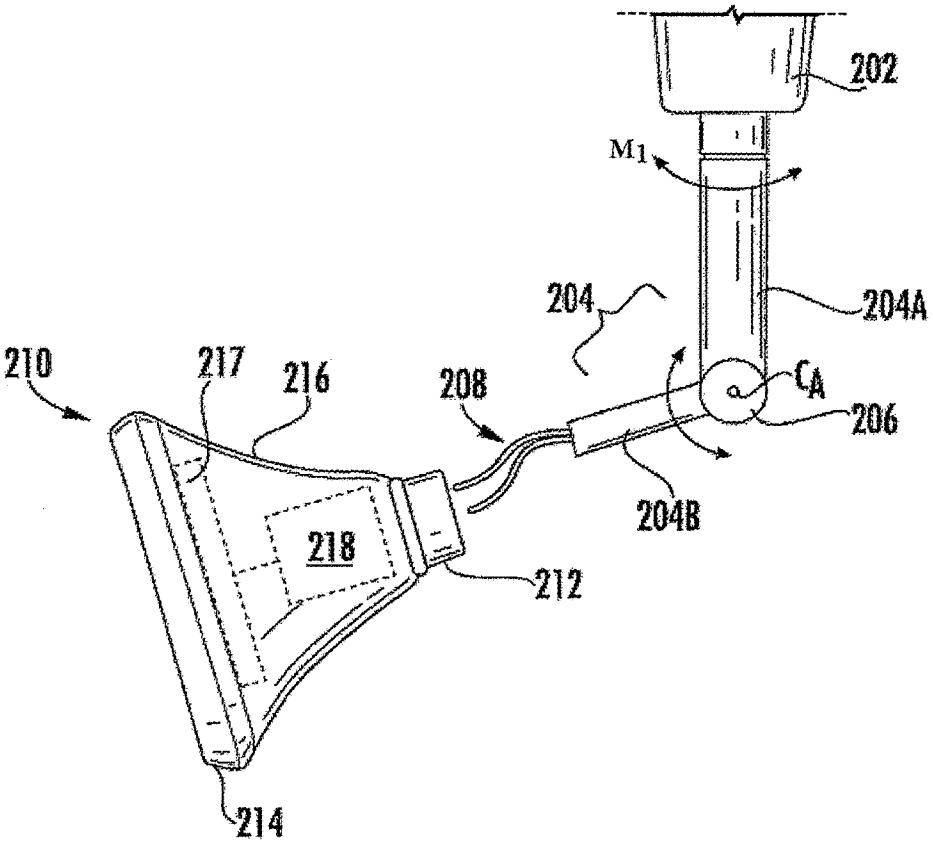
FIG. 8 illustrates a perspective view of a track head according to some embodiments described herein.

FIG. 8 illustrates another embodiment of a track head comprising a baseless light bulb assembly. In the embodiment of FIG. 8, the conduit 204 is partitioned into two segments 204A and 204B connected by a joint 206. While two conduit segments are illustrated in FIG. 8, any number of conduit segments is contemplated. The number of conduit segments can be selected according to several considerations including, but not limited to, aesthetic features of the track head and degrees of freedom for directional movement of the track head. In some embodiments, the joint 206 comprises a central axis ($C_A$) about which the second segment 204B pivots and/or rotates. The motion of the second segment 204B is depicted by the double-sided arrow, whereby it is understood that the second segment 204B pivots, rotates and/or otherwise moves relative to the first segment 204A via joint 206. Moreover, the conduit 204 can have rotatable engagement $M_1$ with the track mount 202. In such embodiments, the conduit 204 can rotate a full 360 degrees. In other embodiments, the conduit can rotate less than 360 degrees, such as 270 degrees or 180 degrees. One or more stops can be used restrict and/or lock rotational position of the conduit 204 relative to the track mount 202, in some embodiments.

Electrical leads 208 extend in the conduit 204 for connecting with power circuitry 218 of the baseless light bulb assembly 210. The baseless light bulb assembly 210 comprises a bulb envelope 216 enclosing a light source 217 and the power circuitry 218. The bulb envelope 216 comprises a light emitting end or face 214 and an opposing end 212 where a base would normally reside for coupling to a light bulb socket or holder. In the embodiment of FIG. 8, the electrical leads 208 pass into the bulb envelope 210 for connection with power circuitry 218. A joint (not shown) can couple the baseless light bulb assembly 210 to conduit segment 204B. Any suitable joint architecture can be employed to couple the baseless light bulb assembly 216 with conduit segment 204B. In some embodiments, a rotatable joint as illustrated in FIG. 7 can be used. Coupling the conduit to the bulb envelope obviates the requirement of a socket or holder for the light bulb. As detailed herein, the absence of a light bulb socket or holder also eliminates support structures from the track head, such as one or more gimbals. Elimination of a light bulb holder or socket and associated support structures, in some embodiments, produces a streamlined and aesthetically pleasing track head where the track mount, conduit and light bulb or lamp constitute the visible features of the track head. Additionally, inclusion of power circuitry within the bulb envelope can obviate a separate LED driver housing or LED driver box from the track head architecture.

Turning now to specific components, the track head comprises a track mount. Any track mount or adapter not inconsistent with the objectives of the present invention can be used. A track mount, for example, can have design compatible with H, J or L track apparatus. Moreover, the track mount can have any shape including round, elliptical or polygonal. In some embodiments, the track mount comprises a collection of straight and curved surfaces in any desired configuration.

The conduit extending from the track mount to the baseless light bulb assembly can have any desired shape. The conduit can have a round or elliptical cross-sectional profile. In other embodiments, the conduit can have a polygonal cross-sectional profile such as triangular, square, rectangular, hexagonal or octagonal. In some embodiments, the conduit cross-sectional profile comprises a collection of straight and curved surfaces in any desired configuration, such as a helical or braided configuration. The conduit can also have any desired cross-sectional width not inconsistent with the objectives of the present invention. The conduit exhibits a minimum width to accommodate the electrical leads passing from the track mount to the power circuitry of the baseless light bulb assembly. Width of the conduit can be constant from the track mount to the baseless light bulb assembly. Alternatively, the conduit can have a variable width from the track mount to the baseless light bulb assembly. Width of the conduit can increase and/or decrease in any desired manner along the conduit length. In some embodiments, conduit width can taper between the track mount and the baseless light bulb assembly. In some embodiments, the conduit is a single continuous piece extending form the track mount to the baseless light bulb assembly. In other embodiments, the conduit comprises multiple segments. Multiple segments of a conduit can have the same or different cross-sectional profile and/or cross-sectional width. The conduit can also have any desired length. For example, the conduit can have a length of at least 1 inch. In some embodiments, the conduit has a length of at least 3 inches, at least 6 inches or at least 12 inches. Conduit length can be fixed or variable. In some embodiments of variable length, the conduit has telescoping capability and structure. In other embodiments, the conduit is foamed of multiple segments that are moveable relative to one another for altering overall length of the conduit. For example, individual conduit segments can adopt a lateral or vertical orientation to vary overall conduit length as desired. Conduit length and width can be selected according to several considerations including, but not limited to, desired track head appearance and lighting requirements of the track head environment.

The conduit, in some embodiments, can branch into two or more sub-conduits. For example, the conduit can branch into two sub-conduits prior to coupling with the baseless light bulb assembly. In such embodiments, the sub-conduits may present a gimbal ring appearance to the track head. In some embodiments, electrical leads can be divided between the sub-conduits. In other embodiments, electrical leads can reside in a single sub-conduit. Sub-conduits can also be used to provide various aesthetic features to the track head. In some embodiments, sub-conduits can be curved, straight or any combination thereof. Any number and design of sub-conduits are contemplated. For example, two or more sub-conduits may form a helical or spiral arrangement between the track mount and baseless light bulb assembly. Moreover, the conduit may exhibit two or more branch points between the track mount and baseless light bulb assembly. In some embodiments, sub-conduits extend from the track mount and coalesce into a single conduit. The single conduit exhibits a second branch point prior to reaching the baseless light bulb assembly.

Figure 3:
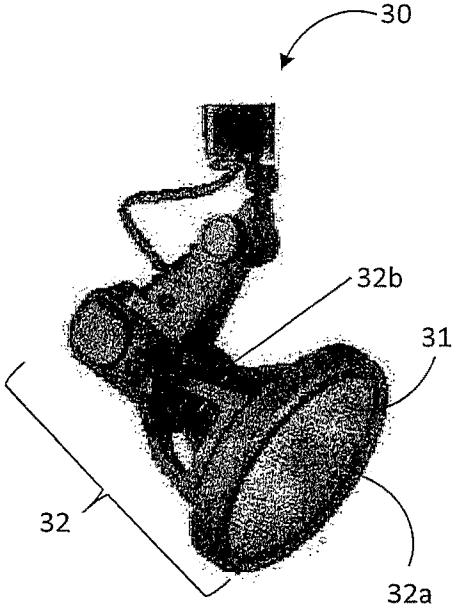
FIG. 3 PRIOR ART
FIG. 3 illustrates a prior track light fixture employing a lamp holder and gimbal architecture.
Figure 2:
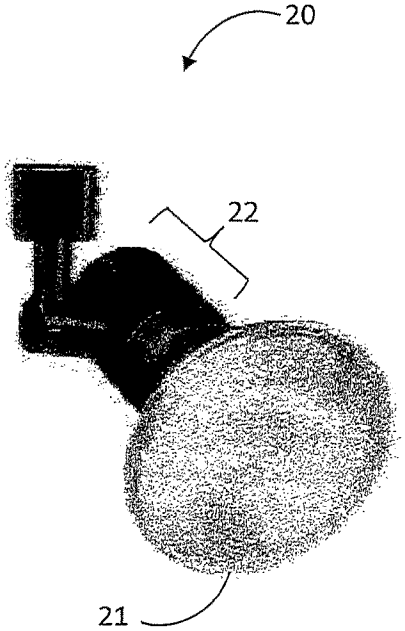
FIG. 2 PRIOR ART
FIG. 2 illustrates a prior track light fixture employing a lamp holder and gimbal architecture.
Figure 5:
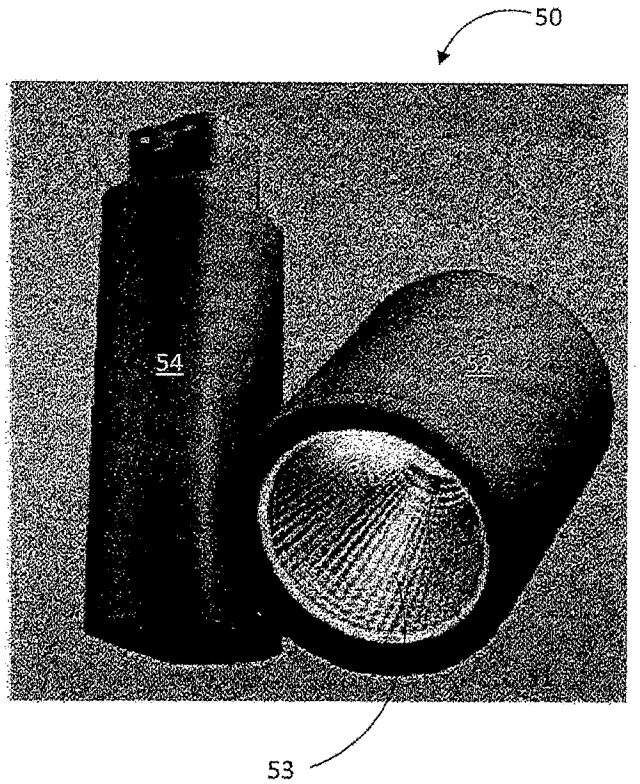
FIG. 5 PRIOR ART
FIG. 5 illustrates a prior track light fixture wherein LEDs are integrated at the base of a cylindrical housing.
Figure 6:
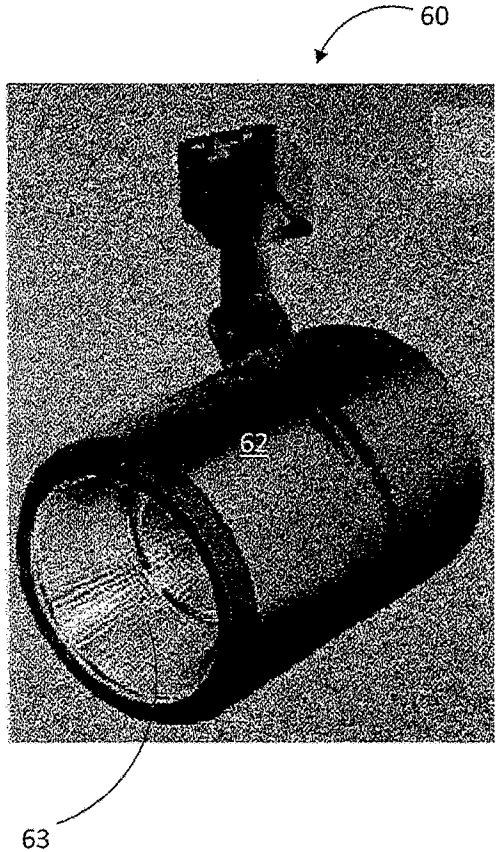
FIG. 6 PRIOR ART
FIG. 6 illustrates a prior track light fixture wherein LEDs are integrated at the base of a cylindrical housing.

As described herein, the conduit couples the bulb envelope of a baseless light bulb assembly. Electrical contacts extend into the bulb envelope to connect with light source power circuitry contained therein. Routing electrical contacts through the conduit to light source power circuitry enclosed by the bulb envelope can enable a baseless light bulb configuration. With the light bulb base absent, a socket or holder is also rendered unnecessary for the track head design. The conduit coupled to the bulb envelope provides sufficient mechanical support for the light bulb assembly. The bulb envelope can have any desired shape not inconsistent with the objectives of the present invention. In some embodiments, for example, the bulb envelope can have a shape selected from the group consisting of A series, E series, G series, P series, PS series, T series, R series, BR series, ER series, ER series and PAR series. The bulb envelopes of FIGS. 2 and 3, for example, have a PAR series shape or profile, and the base, such as an Edison base, is absent from the light bulb assembly. In some embodiments, the baseless light bulb assembly has a bulb envelope shape selected from the American National Standards Institute (ANSI) standards listed in Table I.

TABLE I

| ANSI Standards of Bulb Envelope Shape for Baseless Light Bulb Assembly |
|---|
| ANSI C78.79-2014 for PAR and R Shapes |
| ANSI C78.22-1995 (R2003) for Incandescent A, G, PS Lamps |
| ANSI C78.23-1995 (R2003) for Incandescent Miscellaneous Type Lamps including C, S, T |
| ANSI C78.24-2001 for 2 in. (51 mm) Integral-Reflector Lamps with Front Covers |
| ANSI C78.43-2013 for Single-Ended Metal Halide Lamps |

The bulb envelope comprises one or more light emitting surfaces or faces for providing the desired light distribution from the track head. Light emitting surfaces of the bulb envelope, in some embodiments, can have refractive elements or designs to provide desired light distributions. In some embodiments, the bulb envelope comprises one or more light emitting faces and the remainder of the envelope body is opaque. Light emitting surfaces of the bulb envelope can be transparent, translucent or any combination thereof. Referring once again to the PAR series shape of FIGS. 2 and 3, the bulb envelope 107, 216 comprises a light emitting face 108, 214 wherein the remainder envelop 107, 216 of the is opaque. The opaque exterior of the bulb envelope can have any desired color or finish. In some embodiments, the opaque exterior of the bulb envelope has a matte or diffuse finish that can be of any color and/or material. In other embodiments, the opaque exterior can have a metallic or specularly reflective finish. Additionally, the interior of one or more opaque regions of the bulb envelope can comprise reflective surfaces. The reflective surfaces can be specularly reflective or exhibit diffuse reflectance. Any combination of specularly reflective and/or diffuse reflectance interior surfaces is contemplated. Reflective interior surfaces of the bulb envelope may assist in providing desired light distribution from the light bulb assembly. Reflective interior surfaces may also enhance optical efficiency of the light bulb assembly.

The bulb envelope can have any ratio of light emitting area to opaque area. Different envelope shapes, for example, lend themselves to differing ratios between light emitting area and opaque area. Ratio of light emitting area to opaque are can also be selected according to desired aesthetics of the track head and requirements of the lighting environment.

In some embodiments, one or more opaque regions of the bulb envelope can be replaced by a translucent region. Translucent regions, in some embodiments, transmit light while concealing apparatus and/or circuitry underlying the regions. In other embodiments, apparatus and/or circuitry of the baseless light bulb assembly can be at least partially viewed through the translucent region. A bulb envelope, in some embodiments, can be formed entirely of a translucent material. The translucent material can be uniform over the entire bulb envelope, or the translucent material may vary in transmittance between various regions of the bulb envelope. For example, the translucent material may exhibit higher transmittance at one end of the bulb envelope and lower transmittance in region(s) of the bulb envelope covering power circuitry of the baseless light bulb assembly. Translucent regions of a bulb envelope can be selected according to several considerations including, but not limited to, lighting requirements of the environment, desired aesthetic features of the track lighting system and bulb envelope shape.

The light bulb assembly can employ any type light source not inconsistent with the objectives of the present invention. In some embodiments, the light bulb assembly comprises one or more halogen light sources. One or more light emitting diodes (LEDs) can also serve as the light source of the bulb assembly. In some embodiments, the electrical leads extending within the conduit and passing into the bulb envelope can connect to driver circuitry of the LEDs. LED light sources may comprise packaged LED chip(s) or unpackaged LED chip(s). LED elements or modules can use LEDs of the same or different types and/or configurations. The LEDs, for example, can be monochromatic or any desired color combination. The LEDs can comprise single or multiple phosphor-converted white and/or color LEDs, and/or bare LED chip(s) mounted separately or together on a single substrate or package that comprises, for example, at least one phosphor-coated LED chip either alone or in combination with at least one color LED chip, such as a green LED, a yellow LED, a red LED, etc. The LED module can comprise phosphor-converted white or color LED chips and/or bare LED chips of the same or different colors mounted directly on a printed circuit board (e.g., chip on board) and/or packaged phosphor-converted white or color LEDs mounted on the printed circuit board, such as a metal core printed circuit board or FR4 board. In some embodiments, the LEDs can be mounted directly to a heat sink or another type of board or substrate. Depending on the embodiment, LED arrangements or lighting arrangements using remote phosphor technology can be employed as would be understood by one of ordinary skill in the art, and examples of remote phosphor technology are described in U.S. Pat. No. 7,614,759, assigned to the assignee of the present invention and hereby incorporated by reference.

In those cases where a soft white illumination with improved color rendering is to be produced, each LED element or module or a plurality of such elements or modules may include one or more blue shifted yellow LEDs and one or more red or red/orange LEDs as described in U.S. Pat. No. 7,213,940, assigned to the assignee of the present invention and hereby incorporated by reference. The LEDs may be disposed in different configurations and/or layouts along one or more edges of the waveguide body, as desired. Different color temperatures and appearances could be produced using other LED combinations of single and/or multiple LED chips packaged into discrete packages and/or directly mounted to a printed circuit board as a chip-on board arrangement. In one embodiment, the light sources can comprise any LED, for example, an XP-Q LED incorporating TrueWhite® LED technology or as disclosed in U.S. patent application Ser. No. 13/649,067, filed Oct. 10, 2012, entitled "LED Package with Multiple Element Light Source and Encapsulant Having Planar Surfaces" by Lowes et al., the disclosure of which is hereby incorporated by reference herein, as developed and manufactured by Cree, Inc., the assignee of the present application. In another embodiment, the light sources can comprise XQ-E LEDs developed by Cree, Inc.

Any of the embodiments disclosed herein incorporating LED light sources may include power or driver circuitry having a buck regulator, a boost regulator, a buck-boost regulator, a fly-back converter, a SEPIC power supply or the like and/or multiple stage power converter employing the like, and may comprise a driver circuit as disclosed in U.S. patent application Ser. No. 14/291,829, filed May 30, 2014, entitled "High Efficiency Driver Circuit with Fast Response" by Hu et al. or U.S. patent application Ser. No. 14/292,001, filed May 30, 2014, entitled "SEPIC Driver Circuit with Low Input Current Ripple" by Hu et al. incorporated by reference herein. The circuit may further be used with light control circuitry that controls color temperature of any of the embodiments disclosed herein, such as disclosed in U.S. patent application Ser. No. 14/292,286, filed May 30, 2014, entitled "Lighting Fixture Providing Variable CCT" by Pope et al. incorporated by reference herein.

When LEDs are present as the light source, opaque regions of the bulb envelope can be constructed of materials having suitable thermal conductivities to serve as a heat sink. Opaque regions of the bulb envelop may also exhibit shapes and/or structures for enhancing heat dissipation and/or heat flow away from LEDs of the light source. Moreover, opaque regions of the bulb envelope can house and conceal the driver and associated LED power circuitry.

Figure 9:
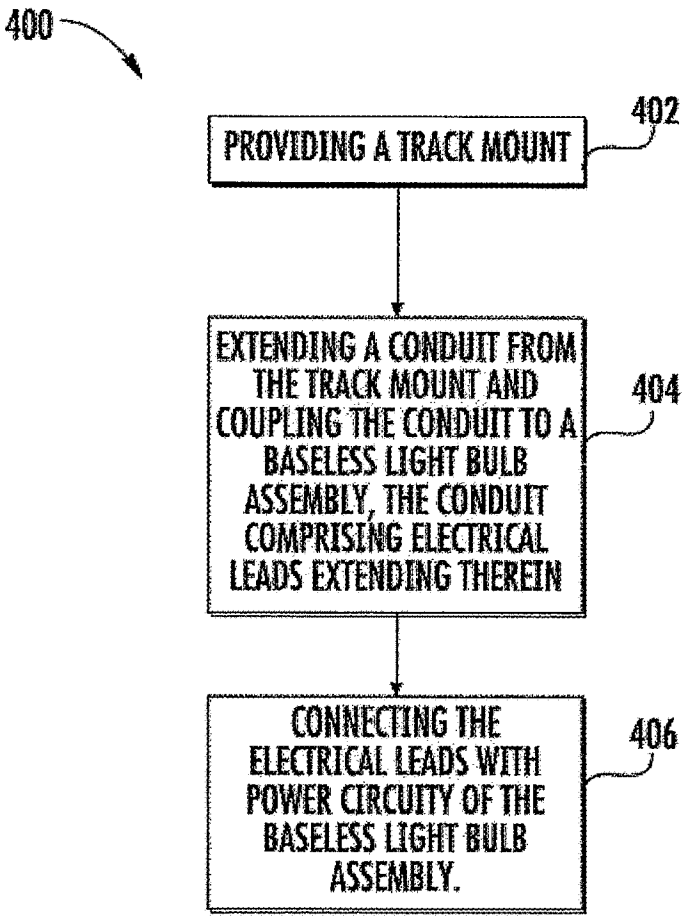
FIG. 9 is a flow chart illustrating several steps of a method of making a track head according to some embodiments described herein.

FIG. 9 is a flow chart illustrating exemplary steps for a method, generally designated 400, of making a track lighting device for a track lighting system according to some embodiments. In the exemplary embodiment, the method includes providing a track mount at 402. The method also includes extending a conduit from the track mount and coupling the conduit to a baseless light bulb assembly at 404, the conduit comprising electrical leads extending therein. The electrical leads connect with power circuitry of the baseless light bulb assembly at 406. In some embodiments, for example, the conduit couples to the bulb envelope enclosing a light source and the power circuitry. The electrical leads pass through the bulb envelope and connect with the power circuitry contained therein. In some embodiments, the electrical leads connect with the driver and associated circuitry for LED light sources. As such, the light bulb assembly does not require a base and associated socket or holder as in prior track head designs. As persons skilled in the art will appreciate, additional, fewer, and/or different steps may be provided, where desired, and remain consistent with the instant disclosure.

In a further aspect, track lighting systems are described herein. A track lighting system comprises one or more powered rails or powered monopoints. The track lighting system also comprises one or more track heads, a track head comprising a track mount and a conduit extending from the track mount and coupling to a baseless light bulb assembly, the conduit comprising electrical leads extending therein and connecting with power circuitry of the baseless light bulb assembly. Track heads of track lighting systems can have any construction and/or properties described herein. The powered rails or powered monopoints can have any construction, including H, J or L-type architectures for connection with track mounts or adaptors of the track heads. Powered rails can comprise straight sections, curved sections and any combination thereof. Track path length and shape can be set according to several considerations including, but not limited to, lighting requirements of the environment and desired aesthetic features of the track lighting system. Powered monopoints can have any shape including circular, elliptical or polygonal. In some embodiments, powered monopoints have shapes combining polygonal and curved features. Any number of powered monopoints can be present in a track lighting system. Powered monopoint number can be selected according to several considerations including, but not limited to, lighting requirements of the environment and desired aesthetic features of the track lighting system.

Various embodiments of the invention have been described in fulfillment of the various objects of the invention. It should be recognized that these embodiments are merely illustrative of the principles of the present invention. Numerous modifications and adaptations thereof will be readily apparent to those skilled in the art without departing from the spirit and scope of the invention.

The invention claimed is:

1. A track head for a track lighting system, the track head comprising:

a track mount;

a baseless light bulb assembly without a light bulb socket; and a conduit extending from the track mount and coupling to the baseless light bulb assembly, the conduit comprising electrical leads extending therein and connecting with power circuitry of the baseless light bulb assembly.

2. The track head of claim 1, wherein the baseless light bulb assembly comprises a bulb envelope enclosing a light source and the power circuitry.

3. The track head of claim 2, wherein the conduit couples to the bulb envelope.

4. The track head of claim 3, wherein the conduit couples to the bulb envelope via a rotatable joint.

5. The track head of claim 3, wherein the electrical leads pass through the bulb envelope to connect with the power circuitry of the baseless light bulb assembly.

6. The track head of claim 1, wherein the conduit is directionally adjustable.

7. The track head of claim 1, wherein the conduit comprises segments coupled by one or more joints.

8. The track head of claim 7, wherein the conduit comprises two or more segments that are movable relative to one another.

9. The track head of claim 1, wherein the conduit has rotatable engagement with the track mount.

10. The track head of claim 2, wherein the light source comprises one or more light emitting diodes.

11. The track head of claim 10, wherein the electrical leads connect with driver circuitry within the bulb envelope.

12. The track head of claim 1, wherein the bulb envelope has a shape selected from the group consisting of A series, E series, G series, P series, PS series, S series, T series, R series, BR series, ER series and PAR series.

13. The track head of claim 1, wherein the conduit is permanently coupled to the baseless light bulb assembly.

14. The track head of claim 1 lacking a housing or gimbal for receiving the baseless light bulb assembly.

15. A method of making a track head of a track lighting system comprising:

providing a track mount;

extending a conduit from the track mount and coupling the conduit to a baseless light bulb assembly, the conduit comprising electrical leads extending therein and the baseless light bulb assembly being without a light bulb socket; and connecting the electrical leads with power circuitry of the baseless light bulb assembly.

16. The method of claim 15, wherein the baseless light bulb assembly comprises a bulb envelope enclosing a light source and the power circuitry.

17. The method of claim 16, wherein the conduit couples to the bulb envelope.

18. The method of claim 17, wherein the conduit couples to the bulb envelope via a rotatable joint.

19. The method of claim 16, wherein the light source comprises one or more light emitting diodes.

20. The method of claim 19, wherein the electrical leads pass through the bulb envelope to connect with driver circuitry within the bulb envelope.

21. The method of claim 15, wherein the track head lacks a housing or gimbal for receiving the baseless light bulb assembly.

22. A track lighting system comprising:

one or more powered rails or powered monopoints;

a baseless light bulb assembly without a light bulb socket; and one or more track heads, a track head comprising a track mount and a conduit extending from the track mount and coupling to the baseless light bulb assembly, the conduit comprising electrical leads extending therein and connecting with power circuitry of the baseless light bulb assembly.

23. The track lighting system of claim 22, wherein the baseless light bulb assembly comprises a bulb envelop enclosing a light source and the power circuitry.

24. The track lighting system of claim 23, wherein the conduit is coupled to the bulb envelope.

25. The track lighting system of claim 24, wherein the electrical leads pass through the bulb envelope to connect with the power circuitry of the baseless light bulb assembly.

* * * * *